US010016071B2

(12) United States Patent
Nooli et al.

(10) Patent No.: US 10,016,071 B2
(45) Date of Patent: Jul. 10, 2018

(54) PRODUCT MERCHANDISING SYSTEMS AND METHODS

(71) Applicant: PepsiCo, Inc., Purchase, NY (US)

(72) Inventors: Praveen Kumar Nooli, Purchase, NY (US); Atul Tripathi, Purchase, NY (US); Soykan Dirik, Purchase, NY (US)

(73) Assignee: PepsiCo, Inc., Purchase, NY (US)

( * ) Notice: Subject to any disclaimer, the term of this patent is extended or adjusted under 35 U.S.C. 154(b) by 81 days.

(21) Appl. No.: 15/168,901

(22) Filed: May 31, 2016

(65) Prior Publication Data

US 2017/0340138 A1 Nov. 30, 2017

(51) Int. Cl.
*F25D 17/06* (2006.01)
*A47F 3/04* (2006.01)
*A47B 96/02* (2006.01)

(52) U.S. Cl.
CPC ..... *A47F 3/0408* (2013.01); *A47B 96/027* (2013.01); *A47F 3/043* (2013.01); *A47F 3/0491* (2013.01); *F25D 17/06* (2013.01)

(58) Field of Classification Search
CPC ..... A47F 3/0408; A47F 3/043; A47F 3/0491; A47F 3/02; A47F 3/04; A47B 96/027; F25D 17/06
USPC ..... 62/89
See application file for complete search history.

(56) References Cited

U.S. PATENT DOCUMENTS 3,675,440 A 7/1972 Ibrahim
4,977,754 A * 12/1990 Upton ..... A47F 3/0408 221/150 R
5,791,152 A 8/1998 Choi
2001/0042616 A1* 11/2001 Baer ..... H05K 7/20609 165/299
2003/0172670 A1 9/2003 Vormedal
(Continued)

FOREIGN PATENT DOCUMENTS

WO WO 2014/195720 A1 12/2014

OTHER PUBLICATIONS

International Search Report dated Aug. 24, 2017 for Appl. No. PCT/US2017/034373, 3 pages.
(Continued)

*Primary Examiner* — Ana Vazquez
(74) *Attorney, Agent, or Firm* — Sterne, Kessler, Goldstein & Fox P.L.L.C.

(57) ABSTRACT

A product merchandising system includes a housing having a top surface, two side surfaces spaced apart from one another defining a width-direction of the housing, and a front surface and rear surface spaced apart from one another defining a depth-direction of the housing. The system includes a product support system configured to support rows of products along a width of the housing, each row disposed at a position along the depth of the housing, the first row being towards the front surface of the housing. A cooling system includes a cooling system including a cooling heat exchanger generating an airflow, a deflector configured to direct the airflow through the cooling heat exchanger and towards a bottom of the housing, and a nozzle below the deflector and configured to direct the airflow towards a bottom of the housing through an outlet aperture and between a first two rows of products.

20 Claims, 4 Drawing Sheets

(56) References Cited

U.S. PATENT DOCUMENTS

| | | | | |
|---|---|---|---|---|
| 2004/0086008 | A1* | 5/2004 | Gregory | H05B 33/0842 372/34 |
| 2007/0006604 | A1* | 1/2007 | Behr | A47F 3/0443 62/246 |
| 2008/0098761 | A1* | 5/2008 | Zangari | A47F 3/0408 62/249 |
| 2009/0255287 | A1 | 10/2009 | Alahyari et al. | |
| 2011/0265503 | A1 | 11/2011 | Zangari et al. | |
| 2013/0316635 | A1 | 11/2013 | Sipilä et al. | |
| 2015/0245721 | A1 | 9/2015 | Nugroho et al. | |

OTHER PUBLICATIONS

Written Opinion of International Searching Authority dated Aug. 24, 2017 for Appl. No. PCT/US2017/034373, 8 pages.

* cited by examiner

PRODUCT MERCHANDISING SYSTEMS AND METHODS

FIELD

The described embodiments relate generally to a product merchandising system. In particular, embodiments relate to cooling systems and methods used in a product merchandising systems such as coolers or vending machines.

BACKGROUND

Various systems and methods for cooling products to be cooled in a cooler or vending machine may be used.

SUMMARY

Some embodiments are directed towards a product merchandising system. The product merchandising system may include a housing having a top surface, two side surfaces spaced apart from one another defining a width-direction of the housing, and a front surface and rear surface spaced apart from one another defining a depth-direction of the housing. In embodiments, the product merchandising system may include a product support system configured to support rows of products along a width of the housing, each row disposed at a position along the depth of the housing, the first row being towards the front surface of the housing. In embodiments, the product merchandising system may include a cooling system including a cooling heat exchanger, and a blower, the blower disposed forward from the cooling heat exchanger and configured to pull air through the cooling heat exchanger generating an airflow. In some embodiments, the cooling heat exchanger may be disposed within the housing and proximate the top surface of the housing. In some embodiments, the cooling system may include a deflector configured to direct the airflow through the cooling heat exchanger and towards a bottom of the housing, and a nozzle below the deflector and configured to direct the airflow towards a bottom of the housing through an outlet aperture and between a first two rows of products.

In some embodiments, the outlet aperture may include a tapered surface configured to jet the airflow through the first two rows of products. In some embodiments, the tapered surface may extend along substantially the entire width of the housing. In some embodiments, the outlet aperture may include at least two tapered surfaces configured to jet the air through the first two rows of products.

In some embodiments, the nozzle may include a planar surface extending parallel to the top surface of the housing and coacting with the deflector and side surfaces of the housing such that the airflow is directed through the region as an air duct.

In some embodiments, the blower may be a cross-flow blower.

In some embodiments, the product support system may further include wire shelves positioned along a height direction of the housing such that multiple arrays of products may be supported in parallel planes, the wire shelves being configured to allow the airflow through the first two rows of products. In some embodiments, the wire shelves are positioned such that they are inclined towards the front of the housing.

In some embodiments, a cool-down time of the first two rows of products is reduced by at least 45% when the cooling system is activated. In some embodiments, a cool-down time of the first two rows of products is reduced by at least 60% when the cooling system is activated. In some embodiments, a cool-down time of the first two rows of products is reduced by at least 75% when the cooling system is activated. In some embodiments, a cool-down time of the first two rows of products is reduced by at least 90% when the cooling system is activated. In some embodiments, a cool-down time of the first two rows of products is reduced by at least 95% when the cooling system is activated.

In some embodiments, the cooling system further includes a compressor and condenser, wherein the cooling heat exchanger is an evaporator. In some embodiments, the cooling heat exchanger is one of an evaporator, thermoelectric cooler, cold plate, or cooling water heat exchanger.

In some embodiments, the system includes a temperature sensor positioned proximate the lower portion of the support system and configured to monitor temperature of the airflow such that the first two rows of products are controlled within a predetermined temperature range. In some embodiments, the temperature sensor comprising one of a thermistor, thermocouple, bimetallic strip, or infrared sensor.

In some embodiments, the system includes a return airflow region disposed proximate the rear surface of the housing such that the return airflow flows generally upward towards the cooling heat exchanger along the rear surface of the housing. In some embodiments the nozzle further includes a planar surface prior to the outlet extending parallel to the top surface of the housing, the planar surface including a return airflow inlet aperture proximate the rear surface of the housing and rearward of the cooling heat exchanger.

In some embodiments, the system maintains the first and second rows of products at approximately 32 degrees Fahrenheit during operation. In some embodiments, the system maintains the third and subsequent rows of products at a higher temperature than approximately 32 degrees Fahrenheit during operation. In some embodiments, the system maintains the rearmost row of product at approximately between 55 degrees Fahrenheit to 65 degrees Fahrenheit during operation.

Some embodiments are directed towards a method of cooling merchandise. In some embodiments, the method includes positioning products on a product support system within a housing and configured to support rows of products along a width of the housing, each row disposed at a position along the depth of the housing, the first row being towards the front surface of the housing, flowing air through a cooling heat exchanger generating an airflow, the cooling heat exchanger disposed within the housing and proximate the top surface of the housing, deflecting airflow through the cooling heat exchanger and towards a bottom of the housing, and generating an air curtain using a nozzle below the deflector and configured to direct the airflow towards a bottom of the housing through an outlet aperture and between a first two rows of products.

Some embodiments are directed towards a product merchandising system, including a housing having a top surface, two side surfaces spaced apart from one another defining a width-direction of the housing, and a front surface and rear surface spaced apart from one another defining a depth-direction of the housing, a product support system configured to support rows of products along a width of the housing on wire shelves positioned along a height direction of the housing such that multiple arrays of products may be supported in parallel planes, the wire shelves being configured to allow airflow therethrough, each row disposed at a position along the depth of the housing, the first row being towards the front surface of the housing, a cooling system including a compressor, condenser, evaporator, and a blower, the blower disposed forward from the evaporator and configured to pull air through the evaporator generating an airflow, the evaporator disposed within the housing and proximate the top surface of the housing, a deflector configured to direct the airflow through the evaporator and towards a bottom of the housing, and a nozzle positioned below the deflector and configured to direct the airflow towards a bottom of the housing and including an outlet aperture, the outlet aperture extending along substantially the entire width of the housing and including a tapered surface configured to jet the airflow through the first two rows of products, a planar surface extending parallel to the top surface of the housing and coacting with the deflector and side surfaces of the housing such that the airflow is directed through the region as an air duct, the planar surface further including a return airflow inlet aperture proximate the rear surface of the housing and rearward of the cooling heat exchanger, and a temperature sensor positioned proximate the lower portion of the support system and configured to monitor temperature of the airflow such that the first two rows of products are controlled within a predetermined temperature range that is lower than the rows rearward of the second row.

BRIEF DESCRIPTION OF THE DRAWINGS

The disclosure will be readily understood by the following detailed description in conjunction with the accompanying drawings, wherein like reference numerals designate like structural elements, and in which.

DETAILED DESCRIPTION

Figure 1:
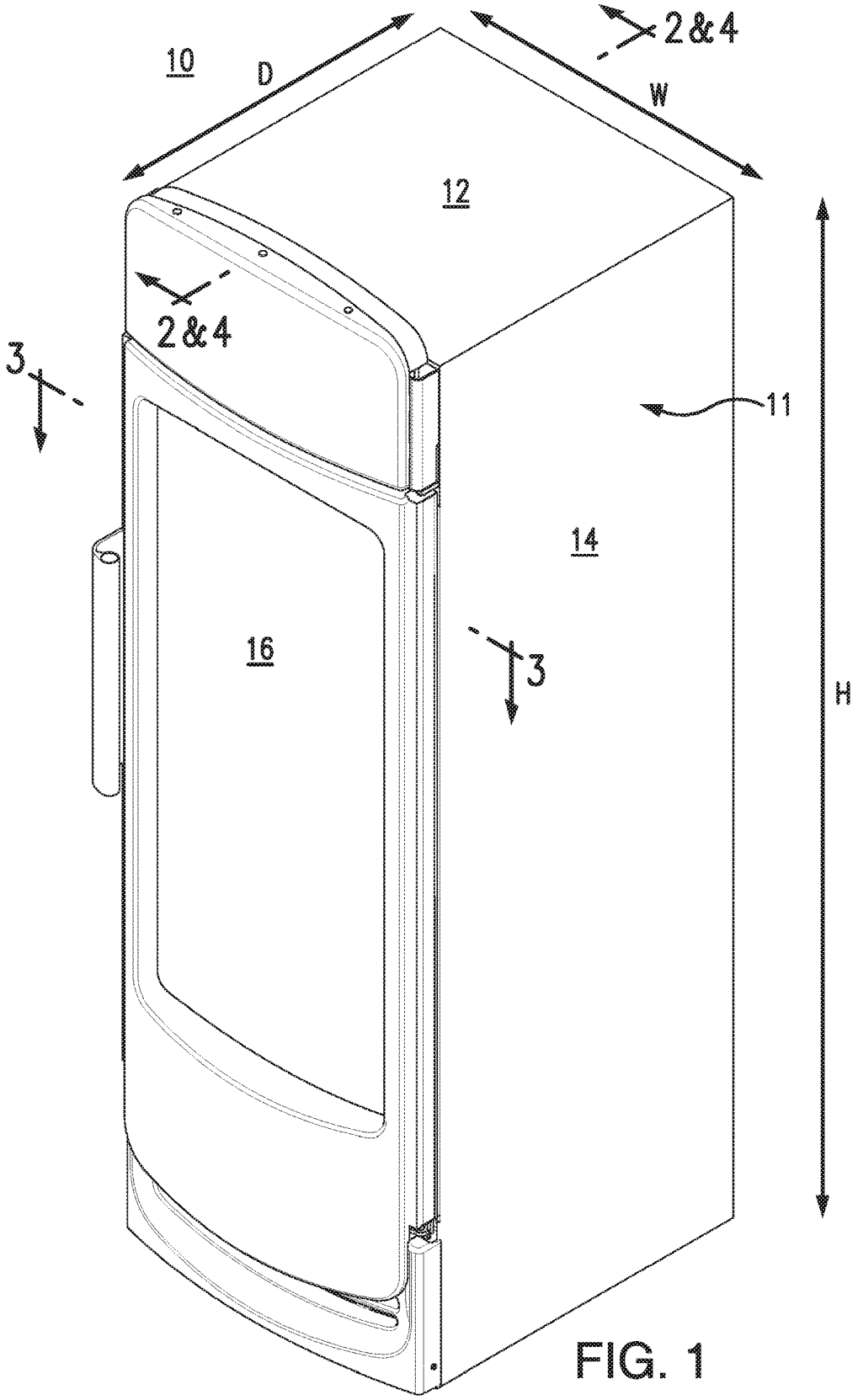
FIG. 1 shows perspective view of a product merchandising system according to an embodiment.

The present invention(s) will now be described in detail with reference to embodiments thereof as illustrated in the accompanying drawings. References to "one embodiment", "an embodiment", "an exemplary embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

These and other embodiments are discussed below with reference to the figures. However, those skilled in the art will readily appreciate that the detailed description given herein with respect to these figures is for explanatory purposes only and should not be construed as limiting. As used herein, ranges are inclusive of the end points, and "from," "between," "to," "and," as well as other associated language includes the end points of the ranges. As used herein, "approximately" or "about" may be taken to mean within 10% of the recited value, inclusive.

Product merchandisers such as coolers or vending machines operate on high energy requirements to cool an entire cooler down to a specified temperature. As a result, this contributes to excess operation cost and decreased efficiency, not to mention energy concerns stemming from potential non-renewable energy expenditure. In developing areas, such product merchandisers are frequently operated in areas where electricity may be inconsistent or unreliable, adding to the concerns with keeping products at sellable temperatures without overcooling and wasting energy. Conventional product merchandisers that are cooled typically include cooling systems that cool the entire interior of the cooler, using low speed fans without any targeted cooling. These fans are typically used to circulate air passing through an evaporator operating on a vapor-compression refrigerant cycle, and may be positioned in various places on the interior of the cooler or vending machine.

However, because the articles towards the front of product merchandisers are typically the first units taken by consumers, if the articles towards the front of the product merchandisers are cooled, there may exist an acceptable thermal gradient from the front of the product merchandiser to the rear of the product merchandiser such that the areas (and therefore articles) towards the front of the product merchandiser may be maintained at a cooler temperature than the rest of the product merchandiser.

Use of the described systems and methods may decrease the time required to cool products for sale in that targeted cooling may be applied to products likely to be consumed first. Additionally, these systems result in energy savings overall as they lower the required cooling power of the system because not all products must be cooled to the same temperature. In some embodiments, energy consumption may decrease by approximately 50-70%. In some embodiments, energy consumption may decrease by approximately 70-90%. In use, some vendors or operators load product merchandisers such as coolers and vending machines from the front to back for convenience. This may result in undesirable temperature distribution because the freshly loaded products are not at a consumer desired temperature (e.g., they are too warm). The embodiments described herein are highly beneficial because they drastically reduce the required time to the get the products for sale towards the front of the product merchandiser to a consumer desired temperature independent of vendor/operator behavior.

Referring to FIG. 1, some embodiments are drawn towards a product merchandising system 10 having a housing 11 and a cooling system 300 disposed within housing 11 such that a targeted zone of products 20, for example, the first two rows of products 20, is cooled to a predetermined temperature that is lower than a non-targeted zone, for example, the rearmost row or rows or rows behind the second row of products 20.

Figure 2:
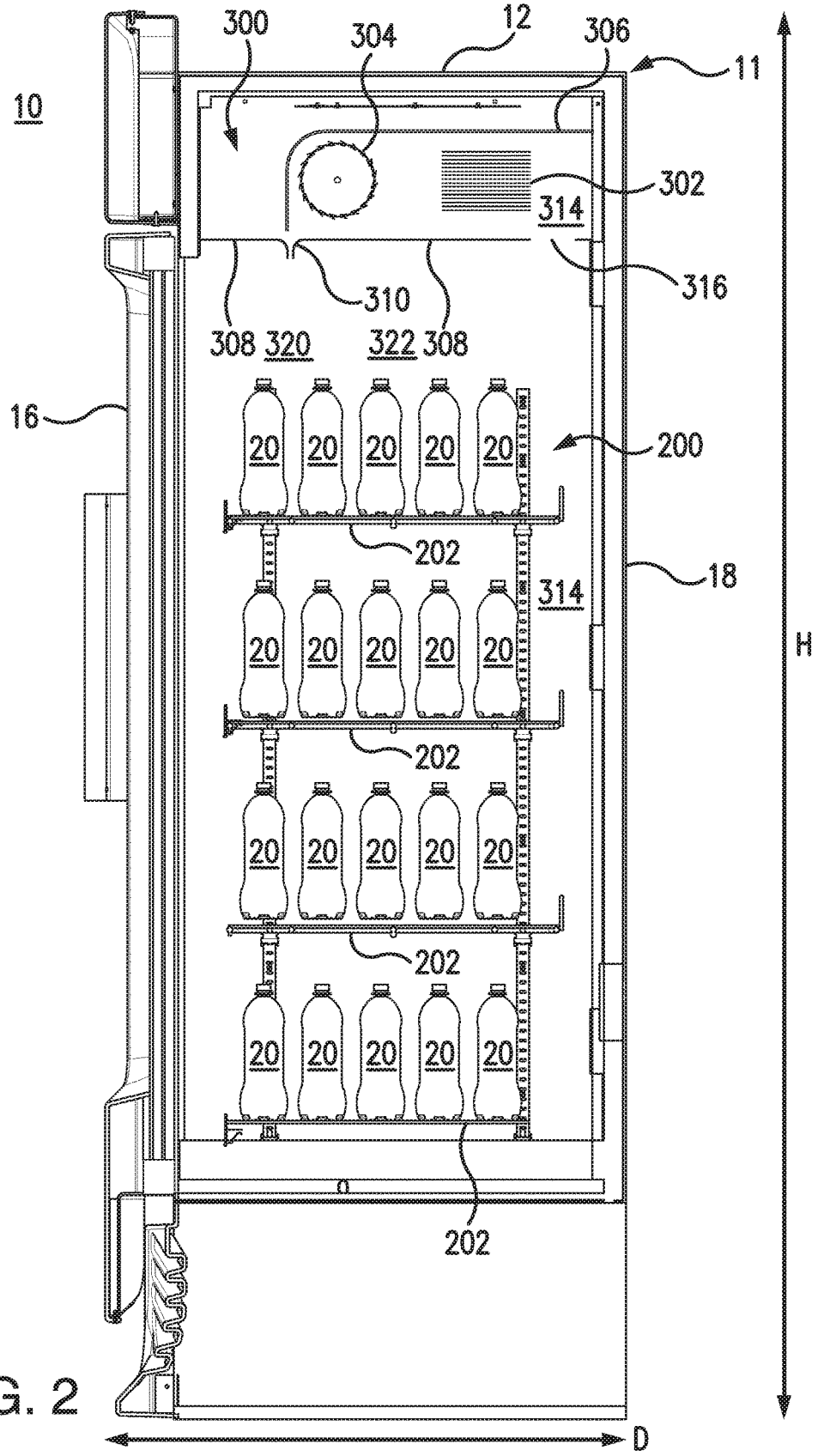
FIG. 2 shows a sectional view of the product merchandising system of FIG. 1, taken along line 2-2 of FIG. 1.
Figure 3:
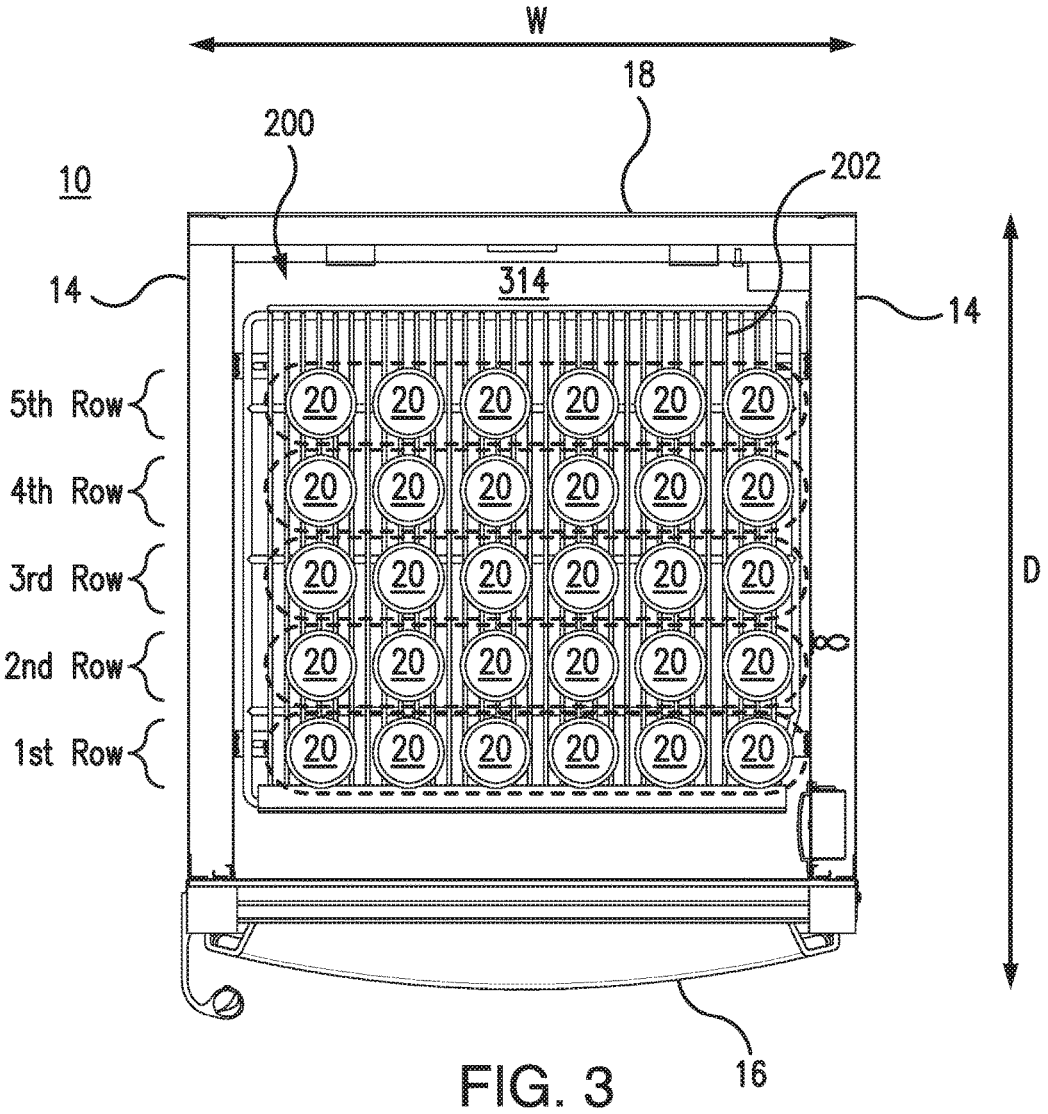
FIG. 3 shows a sectional view of the product merchandising system of FIG. 1, taken along line 3-3 of FIG. 1.

Referring to FIGS. 1-3, some embodiments are drawn towards a product merchandising system 10, its systems, subsystems, components, or related methods. As shown, system 10 may include a cabinet-type housing having side surfaces 14, front surface 16 (such as a door), top surface 12, and rear surface 18. Together, these surfaces may define a cooling environment 318 (interior space) that is configured to maintain a suitable environment within the housing. Additional cooling environments may be further defined within the interior space of product merchandising system 10 to take advantage of multi-zone cooling, for example, if a freezer compartment is included, or if different products 20 require different temperatures for preservation or sale.

As discussed, product merchandising system 10 may include a housing 11 having top surface 12, two side surfaces 14 spaced apart from one another defining a width-direction of housing 11, front surface 16 and rear surface 18 spaced apart from one another defining a depth-direction of housing 11. These surfaces may be generally planar, or may include complex shapes. Generally, however, they may be referred with reference to other components to describe location with reference to the product merchandising system 10 and housing 11.

In some embodiments, product merchandising system 10 may include a product support system 200 configured to support rows of products 20 (e.g., beverages or food products, for example) along a width of housing 11, each row disposed at a position along the depth of housing 11, the first row being towards front surface 16. In some embodiments, product support system 200 may include wire shelves 202 positioned along a height direction of housing 11 such that multiple arrays of products 20 may be supported in parallel planes, as shown, for example, in FIG. 2. The first row of products 20 may include each of the first rows of the multiple arrays of products 20 supported in parallel planes along the height direction of the product merchandising system 10. In some embodiments, wire shelves 202 allow an airflow through the arrays of products 20, flowing in between and around the products 20. In some embodiments, wire shelves 202 allow an airflow through the first two rows of products 20. In some embodiments, wire shelves 202 are positioned such that they are inclined towards the front of housing 11. In this configuration, wire shelves 202 may feed products 20 from the rear of the housing 11 towards the front of the housing 11 when products 20 are removed from the housing, using gravity.

In some embodiments, product merchandising system 10 may include a cooling system 300, as shown, for example, in FIG. 2. Cooling system 300 may include a cooling heat exchanger 302, such as an evaporator, thermoelectric cooler, cold plate, or cooling water heat exchanger, for example. In some embodiments, cooling system 300 further includes a compressor and condenser (not shown), when cooling heat exchanger 302 is an evaporator. In some embodiments, cooling heat exchanger 302 may include fins that are disposed generally parallel to an airflow direction. Cooling system 300 may include electrical and/or mechanical elements and may be fixedly or selectively attached to housing 11. The various walls and doors that make up housing 11 may be insulated to further insulate from external heat. In some embodiments, product merchandising system may include a heating system configured in a similar fashion as cooling system 300, but adding heat to targeted product areas, for example, in a product merchandiser 10 where warm or hot beverages or food products are sold.

In some embodiments, cooling system 300 includes a blower 304, such as a cross-flow blower, centrifugal blower, axial blower, electrostatic fluid accelerator (EFA), or the like. In some embodiments, blower 304 is disposed forward from cooling heat exchanger 302 and configured to pull air through cooling heat exchanger 302 generating an airflow. In some embodiments, cooling heat exchanger 302 is disposed within housing 11 and proximate top surface 12. In some embodiments, cooling system 300 includes a deflector 306 configured to direct the airflow through cooling heat exchanger 302 and towards a bottom of housing 11. In some embodiments, cooling system 300 includes a nozzle 308 positioned below deflector 306 and configured to direct airflow towards a bottom of housing 11 through an outlet aperture 310 and between the first two rows of products 20.

In some embodiments, blower 304 may be disposed within housing 11 and proximate a side surface, or lower surface, for example. In some embodiments, deflector 306 and nozzle 308 may be disposed to direct airflow through cooling heat exchanger 302 towards a top or side of housing 11. In some embodiments, a plurality of blowers 300 and corresponding deflectors 306 and/or nozzles 308 may be provided to direct airflow towards multiple locations within housing 11. In some embodiments, different or additional heat exchangers may be provided that may be cooling heat exchangers, heating heat exchangers, or dual-purpose heat exchangers. In some embodiments, for example, a cold airflow may be directed as described above, that is, through cooling heat exchanger 302 and towards a bottom of housing 11 in addition to a separate airflow directed towards another area within housing 11. In some embodiments, the temperatures of the respective airflows may be the same, or may be different (e.g., one cold airflow and one hot airflow).

Figure 4:
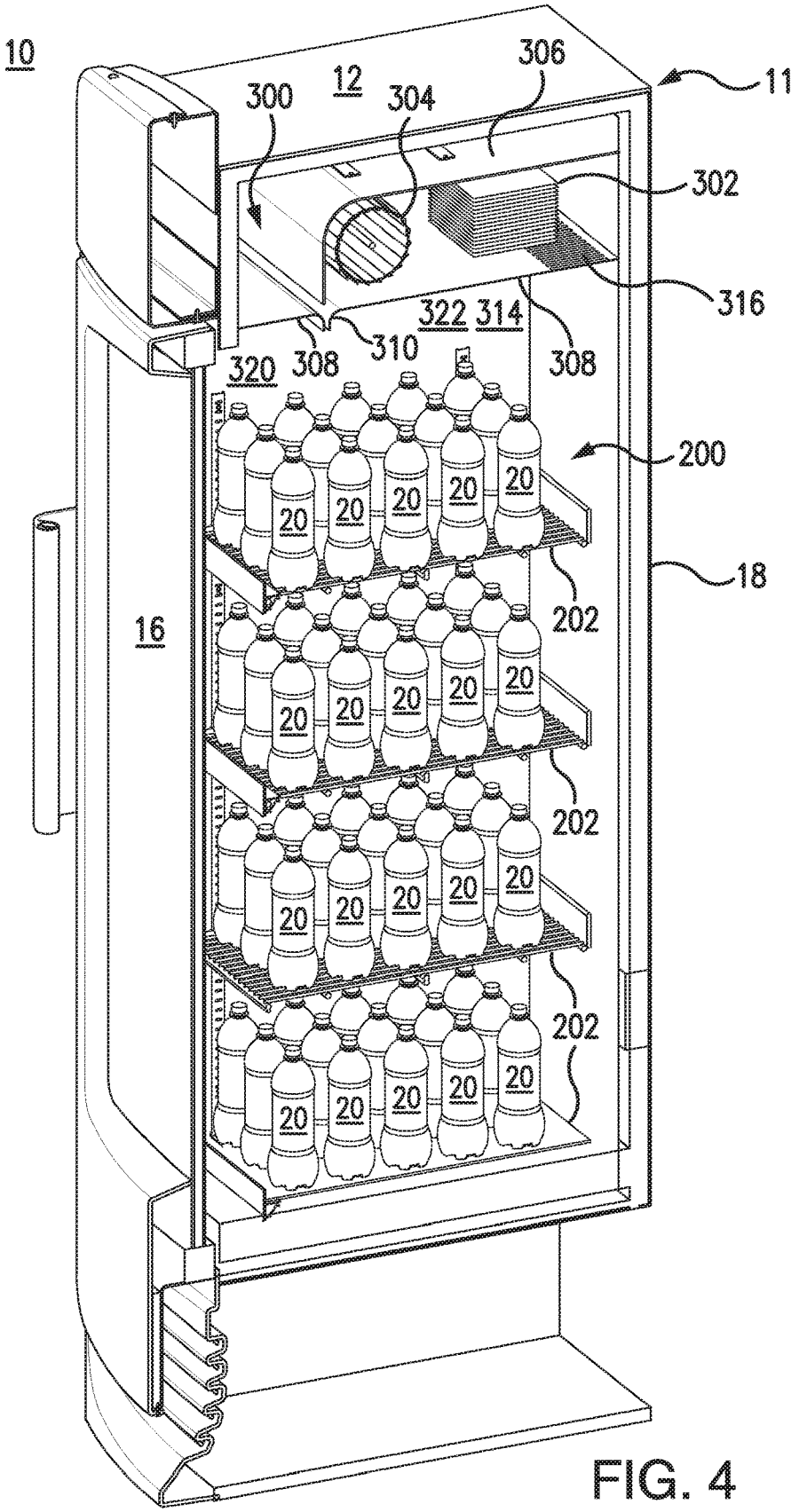
FIG. 4 shows a perspective sectional view of the product merchandising system of FIG. 1, taken along line 4-4 of FIG. 1.

As shown in the figures, in some embodiments, outlet aperture 310 may include a tapered surface configured to jet the airflow through the first two rows of products 20. As used herein, "jet" may be defined as "to cause a rapid stream of fluid to be forced out of a small opening," as in the creation of an air-curtain. In some embodiments, as shown in FIG. 4, for example, the tapered surface extends along substantially the entire width of housing 11. In some embodiments, the outlet aperture 310 further includes at least two tapered surfaces configured to jet the air through the first two rows of products 20. In some embodiments, multiple nozzles 308 may be included. In some embodiments nozzle 308 may include multiple outlet apertures 310. In some embodiments, multiple outlet apertures 310 may be provided as above in different locations to direct airflow towards different areas within the housing. In some embodiments, multiple outlet apertures 310 may be provided along a side of housing 11 in the form of perforations in ducting, for example.

In some embodiments, nozzle 308 includes a planar surface extending generally parallel to top surface 12 of the housing and may operate with deflector 306 and side surfaces 14 of housing 11 such that the airflow is directed through the region as an air duct. In this regard, the structures may act together and increase ease of manufacturability and assembly. In some embodiments, nozzle 308 may be formed sheet metal, for example, or may be molded plastic. In some embodiments, deflector 306 may be formed sheet metal, for example, or may be molded plastic.

In some embodiments, a cool-down time of the first two rows of products 20 is reduced by at least about 45% when cooling system 300 is activated. In some embodiments, a cool-down time of the first two rows of products 20 is reduced by at least about 60% when cooling system 300 is activated. In some embodiments, a cool-down time of the first two rows of products 20 is reduced by at least about 75% when the cooling system 30 is activated. In some embodiments, a cool-down time of the first two rows 20 of products is reduced by at least about 95% when cooling system 30 is activated. These improvements are measured as compared to a conventional system, for example.

In some embodiments, cooling system 300 includes a temperature sensor 312 positioned proximate the lower portion of the support system 200 and configured to monitor temperature of the airflow such that the first two rows of products 20 are controlled within a predetermined temperature range. In some embodiments, temperature sensor 312 may be, for example, a thermistor, thermocouple, bimetallic strip, infrared sensor, or other temperature sensor.

As shown in FIGS. 2-4, for example, in some embodiments, product merchandising system 10 and cooling system 300 may include return airflow region 314 disposed proximate rear surface 18 of housing 11 such that the return airflow flows generally upward towards cooling heat exchanger 302 along rear surface 18 of housing 11. In some embodiments, nozzle 308 further includes a planar surface upstream of outlet aperture 310 extending generally parallel to top surface 12 of housing 11, the planar surface including a return airflow inlet aperture 316 proximate the rear surface of the housing and rearward of the cooling heat exchanger.

In some embodiments, the system maintains a first zone 320 of products 20 at a first temperature during operation. In some embodiments, the system maintains a second zone 322 of products 20 at a second temperature during operation, such that the second zone 322 is at a higher temperature than the first zone 320, such that it creates a temperature gradient between the two zones. In some embodiments, the temperature gradient may be such that the second zone 322 is at a higher temperature than the first zone 320, for example, for an application where warmed beverages or foods are sold. In some embodiments, the first zone 320 may include the first and second rows of products 20. In some embodiments, the first zone 320 may include the first row of products 20. In some embodiments, the first zone 320 may include only the first and second rows of products 20. In some embodiments, the first zone 320 may include only the first row of products 20. In some embodiments, the second zone 322 may be the rear most row of products 20. In some embodiments, the second zone 322 may include rows behind the first row of products 20. In some embodiments, the second zone 322 may include rows behind the first two rows of products 20. For example for a product merchandiser 10 configured as a beverage cooler the desired temperature in the front two rows of products 20 may be between 32 degrees Fahrenheit to 44 degrees Fahrenheit, while the products 20 in the rearmost row could be at an acceptable temperature significantly higher, such as 60 degrees Fahrenheit to 70 degrees Fahrenheit, for example. In other configurations of product merchandiser 10, (e.g., ice-cream freezers, hot beverage or food product vending machines, etc.) the target temperature for the first and second rows of products 20 may vary according to target product temperature at sale. For example, if product merchandiser 10 is an ice-cream freezer, the front two rows may be targeted to an acceptable frozen temperature in order to not melt, but still be consumable immediately after purchase. In another example, if product merchandiser 10 is configured to sell hot beverages or food products, targeted temperatures at the front two rows of products may be higher than the other rows, effectively heating the products for sale prior to consumption. In some embodiments, this process may be automated and controlled, in order to ensure quality experience and avoiding spoilage.

In some embodiments, the system maintains the first and second rows of products at about 32 degrees Fahrenheit during operation. In some embodiments, the system maintains the third and subsequent rows of products at a higher temperature than about 32 degrees Fahrenheit during operation. In some embodiments, the system maintains the rearmost row of product at about 55 degrees Fahrenheit during operation. In this regard, the airflow between the first two rows of products with reference to the front of housing 11 is such that the first two rows of products are maintained at substantially the same temperature. The cold airflow (e.g., cold jets or air curtain) subsequently diffuses as it travels towards the bottom of housing 11. Further diffusion and convection currents may in turn cool the rest of the interior of housing 11. However, a temperature gradient along the depth of housing 11 will be created (e.g., temperature differential), with the rows of products 20 toward the rear of housing 11 being warmer than the first two rows of products 20.

Product merchandising system 10 may include at least one opening that provides access to products within housing 11, such as a door. A thermo-protective barrier (e.g., insulation) may be applied to the various structures that make up the product merchandising system in order to increase thermal efficiency. The thermo-protective barrier may include a glass door, a thermo-protective barrier (such as a sheet designed to retractably extend across the opening), a separate ventilation system designed to maintain a protective air barrier across the opening, and the like. The thermo-protective barrier may extend across any portion of an opening. For example, the thermo-protective barrier may be a curtain that extends across the opening. In another example, the thermo-protective barrier may be a plastic or glass door that extends across the opening. The door may be opened via a hinge configuration, a sliding door configuration, or other suitable arrangement.

As described, product merchandising system 10 may be configured to maintain a suitable temperature for storing and/or displaying products 20, such as beverages, within housing 11 viewed through a portion of front surface 16 (such as a glass door) of housing. In other applications, product merchandising system 10 may be a vending machine with no products 20 visible to a consumer. The product merchandising system 10 may also be configured to maintain additional environmental characteristics of the interior of housing 11, such as humidity, ventilation, air pressure, and the like.

In some embodiments, the system may be operated entirely by an attendant, rather than a consumer.

In some embodiments, an identifier (e.g., barcode, RFID tag, or the like) may be coupled to product 20 and be configured to indicate to the product merchandising system 10 control attributes such as the temperature control, presence or absence of the product 20 within housing 11, or relative positioning of the product 20 within the housing's 11 cooled environment.

In some embodiments, the product merchandising system 10 may include a receiver and/or transmitter that may communicate with a customer or attendant device (e.g., phone, smartphone, tablet, smart watch, etc.). In some embodiments, this communication may allow, for example, an attendant to monitor the temperature of temperature sensor 312 correlated to the temperature of the first two rows of products 20. In some embodiments, this communication may allow, for example, an attendant to monitor the energy usage of the product merchandising system 10, and to in turn monitor energy and cost savings resulting from the usage of the system. In some embodiments, this communication may include instructions on how to use the system, or may include a transactional component, for example, purchasing a beverage through a user interface on the consumer's device. In some embodiments, product merchandising system 10 may include a network, such as, for example, a "cloud" or Internet such that the connected device (e.g., consumer or attendant device) and/or components of the product merchandising system 10 may communicate over the network (e.g., to monitor the temperature of the front rows of products 20). Communication between the components may be one-way or multi-way communication.

In some embodiments, the product 20 may be provided to the consumer from a store attendant. In other embodiments, the product 20 may be dispensed to the consumer through a vending machine operation. In some embodiments, the product merchandising system 10 may include an integrated point-of-sale ("POS") payment system that would dispense the product 20 requiring very little to no interaction from a store attendant.

In some embodiments, this communication may provide customization according to prior customer preferences. For example, when a consumer is within a relatively close distance to the product merchandising system 10, such as within a retail location, the consumer may receive a message on their device with information on special limited time offers, promotions, special flavors available, or the like. In another example, a consumer may prefer Beverage A, when a consumer is within a relatively close distance to product merchandising system 10, the consumer may receive a message on their device informing the consumer where a product merchandising system 10 containing Beverage A may be found and/or purchased.

Examples of various social media and other communication features available for incorporation to the instant systems and methods can be found in U.S. Patent Application Publication No. 2013/0096715, which is hereby incorporated by reference in its entirety. For example, in some embodiments, the systems may be configured to receive instructions in connection with a gift a beverage from one individual to another individual, or provide an interface that allows a recipient of a gift, coupon, or promotion, to hear and/or see an audio, text, and/or video message, such as a message of the party who sent the gift, coupon, or promotion to the recipient, for example between multiple devices.

In some embodiments, the interfaces and communication between systems and/or devices may be networked together through a communications network. Communications network may include, for example: 1) a local area network (LAN); 2) a simple point-to-point network (such as direct modem-to-modem connection); and/or 3) a wide area network (WAN), including the Internet and other commercial based network services. In one aspect, the interfaces and/or devices may be connected to social media computer through communications network or using various protocols, such as TCP/IP, Ethernet, FTP, HTTP, BLUETOOTH, Wi-Fi, ultra wide band (UWB), low power radio frequency (LPRF), radio frequency identification (RFID), infrared communication, IrDA, third-generation (3G) cellular data communications, fourth-generation (4G) cellular data communications, Global System for Mobile communications (GSM), or other wireless communication networks or the like may be used as the communications protocol. The interfaces and communication between systems and/or devices may be physically connected to each other or one or more networks via twisted pair wires, coaxial cable, fiber optics, radio waves or other media. In an aspect, known standard protocols may be used, including Flash, HTMLS, etc.

The term "network" as used herein and depicted in the drawings should be broadly interpreted to include not only systems in which remote storage devices are coupled together via one or more communication paths, but also stand-alone devices that may be coupled, from time to time, to such systems that have storage capability. Consequently, the term "network" includes not only a "physical network" but also a "content network," which is comprised of the data—attributable to a single entity—which resides across all physical networks. A "network," as used herein, may also include a network of "virtual" servers, processes, threads, or other ongoing computational processes which communicate with each other, some or all of which may be hosted on a single machine which may provide information to client servers, processes, threads or other ongoing computational processes on that same machine, other machines, or both.

Some embodiments are directed towards a method of cooling merchandise. In some embodiments, the method includes positioning products on a product support system within a housing and configured to support rows of products along a width of the housing, each row disposed at a position along the depth of the housing, the first row being towards the front surface of the housing, flowing air through a cooling heat exchanger generating an airflow, the cooling heat exchanger disposed within the housing and proximate the top surface of the housing, deflecting airflow through the cooling heat exchanger and towards a bottom of the housing, and generating an air curtain using a nozzle below the deflector and configured to direct the airflow towards a bottom of the housing through an outlet aperture and between a first two rows of products such that a temperature gradient is provided between the first two rows of products and a rearmost row of products.

The foregoing descriptions of the specific embodiments described herein are presented for purposes of illustration and description. These exemplary embodiments are not intended to be exhaustive or to limit the embodiments to the precise forms disclosed. All specific details described are not required in order to practice the described embodiments.

It will be apparent to one of ordinary skill in the art that many modifications and variations are possible in view of the above teachings, and that by applying knowledge within the skill of the art, one may readily modify and/or adapt for various applications such specific embodiments, without undue experimentation, without departing from the general concept of the present invention. Such adaptations and modifications are intended to be within the meaning and range of equivalents of the disclosed embodiments, based on the teaching and guidance presented herein.

The Detailed Description section is intended to be used to interpret the claims. The Summary and Abstract sections may set forth one or more but not all exemplary embodiments of the present invention as contemplated by the inventor(s), and thus, are not intended to limit the present invention and the claims.

The present invention has been described above with the aid of functional building blocks illustrating the implementation of specified functions and relationships thereof. The boundaries of these functional building blocks have been arbitrarily defined herein for the convenience of the description. Alternate boundaries can be defined so long as the specified functions and relationships thereof are appropriately performed.

The phraseology or terminology used herein is for the purpose of description and not limitation, such that the terminology or phraseology of the present specification is to be interpreted by the skilled artisan.

The breadth and scope of the present invention should not be limited by any of the above-described exemplary embodiments, but should be defined in accordance with the claims and their equivalents.

What is claimed is:

1. A product merchandising system, comprising:

a housing having a top surface, two side surfaces spaced apart from one another defining a width-direction of the housing, and a front surface and rear surface spaced apart from one another defining a depth-direction of the housing;

a product support system configured to support rows of products along a width of the housing, each row disposed at a position along the depth of the housing, the first row being towards the front surface of the housing;

a cooling system including a cooling heat exchanger, and a blower, the blower disposed forward from the cooling heat exchanger and configured to pull air through the cooling heat exchanger generating an airflow, the cooling heat exchanger disposed within the housing and proximate the top surface of the housing;

a deflector configured to direct the airflow through the cooling heat exchanger and towards a bottom of the housing; and a nozzle below the deflector and configured to direct the airflow towards a bottom of the housing through an outlet aperture positioned along a plane between a first two rows of products.

2. The system of claim 1, the outlet aperture further comprising:

a tapered surface configured to jet the airflow through the first two rows of products.

3. The system of claim 2, the tapered surface extending along the width of the housing.

4. The system of claim 1, the outlet aperture further comprising:

at least two tapered surfaces configured to jet the airflow through the first two rows of products.

5. The system of claim 1, the nozzle further comprising:

a planar surface extending parallel to the top surface of the housing and disposed adjacent to the deflector and side surfaces of the housing such that the airflow is directed through a region as an air duct.

6. The system of claim 1, wherein the blower is a cross-flow blower.

7. The system of claim 1, the product support system further comprising:

wire shelves positioned along a height direction of the housing configured to support multiple arrays of products in parallel planes, the wire shelves being configured to allow the airflow through the first two rows of products.

8. The system of claim 7, wherein the wire shelves are positioned such that they are inclined towards the front of the housing.

9. The system of claim 1, wherein a cool-down time of the first two rows of products is reduced by at least about 60% when the cooling system is activated.

10. The system of claim 1, the cooling system further comprising:

a compressor and condenser, wherein the cooling heat exchanger is an evaporator.

11. The system of claim 1, the cooling heat exchanger comprising one of an evaporator, a thermoelectric cooler, a cold plate, or a cooling water heat exchanger.

12. The system of claim 1, further comprising a temperature sensor positioned proximate a lower portion of the support system and configured to monitor temperature of the airflow such that the first two rows of products is monitored.

13. The system of claim 12, the temperature sensor comprising one of a thermistor, thermocouple, bimetallic strip, or infrared sensor.

14. The system of claim 1, further comprising:

a return airflow region disposed proximate the rear surface of the housing such that the return airflow flows upward towards the cooling heat exchanger along the rear surface of the housing.

15. The system of claim 1, the nozzle further comprising:

a planar surface prior to the outlet extending parallel to the top surface of the housing, the planar surface including a return airflow inlet aperture proximate the rear surface of the housing and rearward of the cooling heat exchanger.

16. The system of claim 1, wherein the system maintains the first and second rows of products at about 32 degrees Fahrenheit during operation.

17. The system of claim 16, wherein the system maintains the third and subsequent rows of products at a higher temperature than about 32 degrees Fahrenheit during operation.

18. The system of claim 16, wherein the system maintains the rearmost row of product at about 55 degrees Fahrenheit during operation.

19. A method of cooling merchandise, comprising:

positioning products on a product support system disposed within a housing and configured to support rows of products along a width of the housing, each row disposed at a position along the depth of the housing, the first row being towards the front surface of the housing;

flowing air through a cooling heat exchanger generating an airflow, the cooling heat exchanger disposed within the housing and proximate the top surface of the housing;

deflecting airflow through the cooling heat exchanger and towards a bottom of the housing; and generating an air curtain using a nozzle below the deflector and configured to direct the airflow towards a bottom of the housing through an outlet aperture positioned along a plane between a first two rows of products such that a temperature gradient is provided between the first two rows of products and a rearmost row of products.

20. A product merchandising assembly, comprising:

a housing having a top surface, two side surfaces spaced apart from one another defining a width-direction of the housing, and a front surface and rear surface spaced apart from one another defining a depth-direction of the housing;

a product support system configured to support rows of products along a width of the housing on wire shelves positioned along a height direction of the housing such that multiple arrays of products may be supported in parallel planes, the wire shelves being configured to allow airflow therethrough, each row disposed at a position along the depth of the housing, the first row being towards the front surface of the housing;

a cooling system including a compressor, condenser, evaporator, and a blower, the blower disposed forward from the evaporator and configured to pull air through the evaporator generating an airflow, the evaporator disposed within the housing and proximate the top surface of the housing;

a deflector configured to direct the airflow through the evaporator and towards a bottom of the housing; and a nozzle positioned below the deflector and configured to direct the airflow towards a bottom of the housing and including:

an outlet aperture, the outlet aperture positioned along a plane between the first two rows of products and extending along the width of the housing and including a tapered surface configured to jet the airflow through the first two rows of products;

a planar surface extending parallel to the top surface of the housing and coacting with the deflector and side surfaces of the housing such that the airflow is directed through a region as an air duct, the planar surface further including a return airflow inlet aperture proximate the rear surface of the housing and rearward of the cooling heat exchanger; and a temperature sensor positioned proximate the lower portion of the support system and configured to monitor temperature of the airflow such that the first two rows of products are controlled within a predetermined temperature range that is lower than the rows rearward of the second row.

* * * * *